US010428597B2

(12) United States Patent
Zaiser

(10) Patent No.: US 10,428,597 B2
(45) Date of Patent: Oct. 1, 2019

(54) WEAR BAND FOR DOWNHOLE TOOLS

(71) Applicant: GENERAL PLASTICS & COMPOSITES, L.P., Houston, TX (US)

(72) Inventor: Jarrad Zaiser, Missouri City, TX (US)

(73) Assignee: General Plastics & Composites, L.P., Houston, TX (US)

( * ) Notice: Subject to any disclaimer, the term of this patent is extended or adjusted under 35 U.S.C. 154(b) by 400 days.

(21) Appl. No.: 14/717,704

(22) Filed: May 20, 2015

(65) Prior Publication Data

US 2015/0361733 A1 Dec. 17, 2015

Related U.S. Application Data

(60) Provisional application No. 62/011,324, filed on Jun. 12, 2014.

(51) Int. Cl.
*E21B 17/10* (2006.01)

(52) U.S. Cl.
CPC ..... *E21B 17/1085* (2013.01)

(58) Field of Classification Search
CPC ..... E21B 17/10; E21B 17/1085
See application file for complete search history.

(56) References Cited

U.S. PATENT DOCUMENTS

| | | | | |
|---|---|---|---|---|
| 4,043,611 | A * | 8/1977 | Wallace | B22F 7/08 175/320 |
| 4,771,811 | A * | 9/1988 | DeCell | B23P 15/00 138/109 |
| 5,437,342 | A * | 8/1995 | Powada | E21B 17/1085 166/242.1 |
| 5,984,007 | A | 11/1999 | Yuan et al. | |
| 7,513,302 | B2 | 4/2009 | Cassidy et al. | |
| 2002/0054972 | A1* | 5/2002 | Charpentier | E21B 17/1085 428/36.91 |
| 2009/0236091 | A1* | 9/2009 | Hammami | B29C 53/8016 166/242.1 |
| 2017/0114198 | A1* | 4/2017 | Tudor | C08J 5/24 |

* cited by examiner

*Primary Examiner* — Caroline N Butcher
(74) *Attorney, Agent, or Firm* — Jonathan M. Pierce; Porter Hedges LLP

(57) ABSTRACT

A downhole tool comprises a 360-degree wear band placed circumferentially around a portion of the largest outer diameter (OD) of the tool. In some embodiments, the wear band comprises fiber, resin, and a hard mineral. In some embodiments, the hard mineral comprises alumina oxide, carbide, poly crystalline diamond, or combinations thereof. In some embodiments, the wear band has a thickness of from about 0.001 inch to about 0.5 inch or wherein the wear band has a width of from about 0.01 inch to about 1.0 inch or wherein the wear band is flush with the largest OD of the tool. In some embodiments, the portion of the largest outer diameter of the tool is a part of a mule shoe, or a gage ring, or a bottom sub. Methods of making such a wear band are also disclosed.

10 Claims, 3 Drawing Sheets

WEAR BAND FOR DOWNHOLE TOOLS

CROSS-REFERENCE TO RELATED APPLICATIONS

This application claims the benefit under 35 U.S.C. § 119(e) of U.S. Provisional Patent Application No. 62/011,324, filed Jun. 12, 2014, the disclosure of which is hereby incorporated herein by reference in its entirety for all purposes.

STATEMENT REGARDING FEDERALLY SPONSORED RESEARCH OR DEVELOPMENT

Not Applicable.

BACKGROUND

Field of the Invention

This invention generally relates to downhole well tools, and in particular, to a tool having a wear band that covers a portion of the largest outer diameter of the tool circumferentially in a 360 degree manner.

Background of the Invention

A multilateral well, also known as a multi-branch well, is a well having one or more lateral boreholes branching off a single primary wellbore. The primary wellbore may be vertical, horizontal, or deviated. The lateral boreholes may branch off the primary wellbore in any number of directions to allow production from several target reservoirs or formations through the primary wellbore. Multilateral wells are advantageous in comparison to single wells in that their lateral boreholes can be brought into close contact with several target reservoirs, thereby allowing production from the reservoirs to be maximized.

The horizontal lengths of newer wells are becoming longer and longer. When a frac or bridge plug is pumped down hole, the plug tends to wear on one side because it is not being rotated on a drill string. It is possible to use ceramic buttons to help reduce this wear. However, unless these buttons are placed every half inch around the diameter, there is still the possibility that the plug will be wearing in between the buttons.

Accordingly, there is continuing need and interest to develop better wear-resistant downhole tools.

SUMMARY

Herein disclosed is a downhole tool comprising a 360-degree wear band placed circumferentially around a portion of the largest outer diameter (OD) of the tool. In some embodiments, the wear band comprises fiber, resin, and a hard mineral. In some embodiments, the hard mineral comprises alumina oxide, carbide, poly crystalline diamond, or combinations thereof. In some embodiments, the wear band has a thickness of from about 0.001 inch to about 0.5 inch or wherein the wear band has a width of from about 0.01 inch to about 1.0 inch or wherein the wear band is flush with the largest OD of the tool. In some embodiments, the portion of the largest outer diameter of the tool is a part of a mule shoe, or a gage ring, or a bottom sub. In some embodiments, the downhole tool comprises more than one wear bands.

Herein also disclosed is a method of making a downhole tool comprising creating a 360-degree groove around a portion of the largest outer diameter of the tool circumferentially; filling the groove with fiber, resin, and a hard mineral to form a wear band; and curing the part. In some embodiments, more than one wear bands are formed on the downhole tool. In some embodiments, the portion of the largest outer diameter of the tool is a part of a mule shoe, or a gage ring, or a bottom sub. In some embodiments, the groove has a depth of from about 0.001 inch to about 0.5 inch or a width of from about 0.01 inch to about 1.0 inch or both. In some embodiments, the groove is filled while the tool is rotated along its longitudinal axis. In some embodiments, the groove is filled until a wear band is formed being flush with the largest OD of the tool. In some embodiments, the hard mineral comprises alumina oxide, carbide, poly crystalline diamond, or combinations thereof. In some embodiments, the tool is cured at a temperature in the range of from 150° F. to 450° F. In some embodiments, the wear band protects the tool from wear and damage.

Further disclosed herein is a method of making a downhole tool comprising creating a 360-degree groove around a portion of the largest outer diameter of the tool circumferentially; wrapping the groove with a pre-preg material; layering a hard mineral on top of the pre-preg material; and curing the part. In some embodiments, the portion of the largest outer diameter of the tool is a part of a mule shoe, or a gage ring, or a bottom sub. In some embodiments, the groove is about 0.01-1.0 inch wide or 0.001-0.5 inch deep or both. In some embodiments, the hard mineral comprises alumina oxide, carbide, poly crystalline diamond, or combinations thereof. In some embodiments, the pre-preg material and the hard mineral form a wear band after curing. In some embodiments, more than one wear bands are formed on the downhole tool. In some embodiments, the wear band is flush with the largest OD of the tool. In some embodiments, the wear band protects the tool from wear and damage.

The present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 2A is the isometric projection view. FIG. 2B shows a groove on the tool for the placement of the wear band.

DETAILED DESCRIPTION

Overview.

Figure 1:
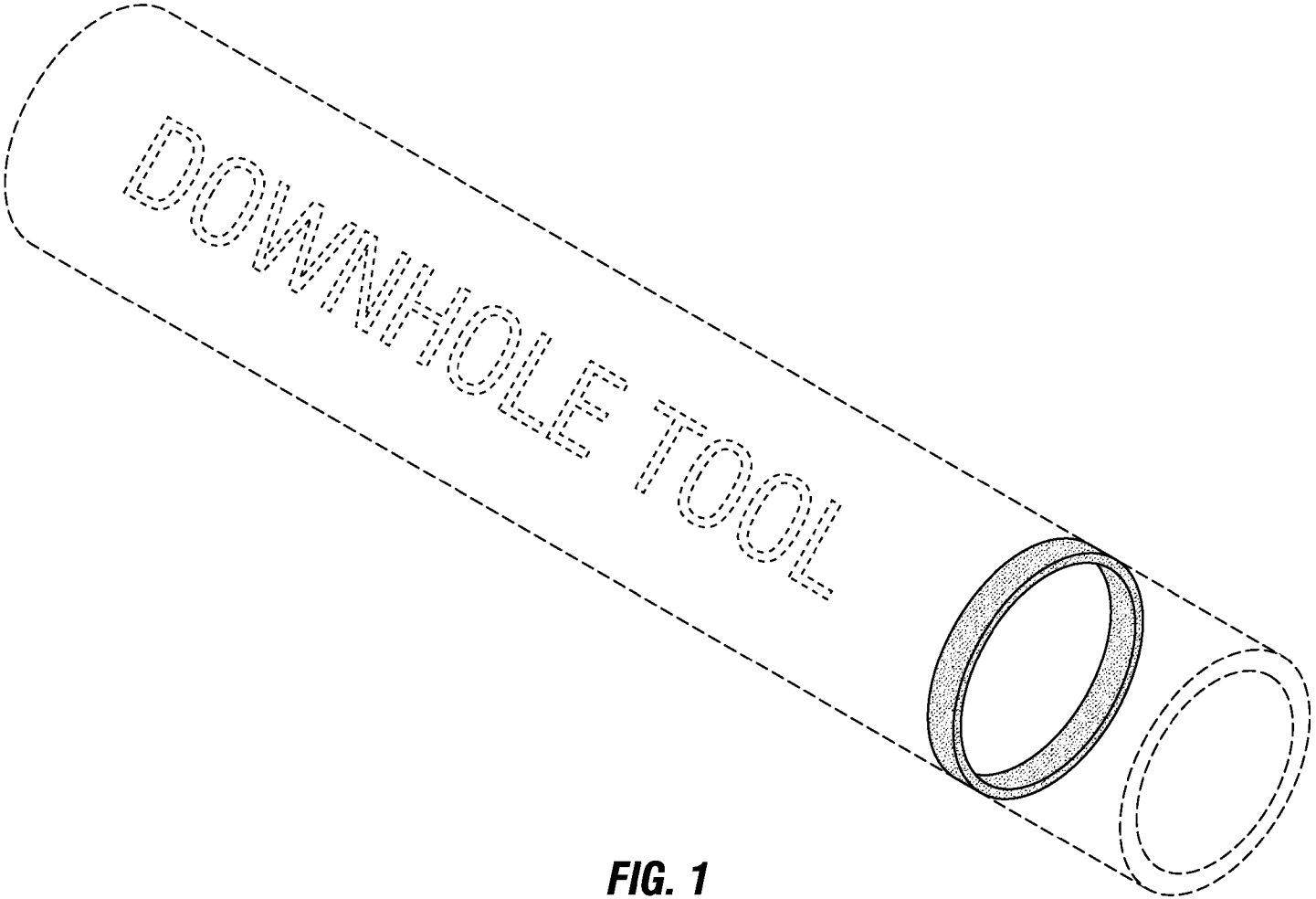
FIG. 1 illustrates a 360-degree wear band placed circumferentially over a portion of the largest outer diameter of a downhole tool, according to an embodiment of this disclosure.

In order to protect the downhole tool from wear, a wear band is placed over a portion of the tool to cover 360 degrees of the circumference of the tool outer diameter (OD), wherein said portion has the largest OD of the tool, as illustrated in FIG. 1. This way no matter how the plug lays in the casing, the wear band will protect it from wear and damage. In various embodiments, the wear band is placed over a mule shoe, or a gage ring, or a bottom sub, which protects the rest of the tool from wear and damage. In various embodiments, the wear band is applied to a downhole tool such as bridge plug, frac plug, or a wireline tool, e.g., measuring while drilling (MWD) and logging while drilling (LWD) tools. In some embodiments, more than one wear band is placed over the tool. The location(s)/position(s) of the wear band(s) is determined by the specific tool and its use.

Figure 2A:
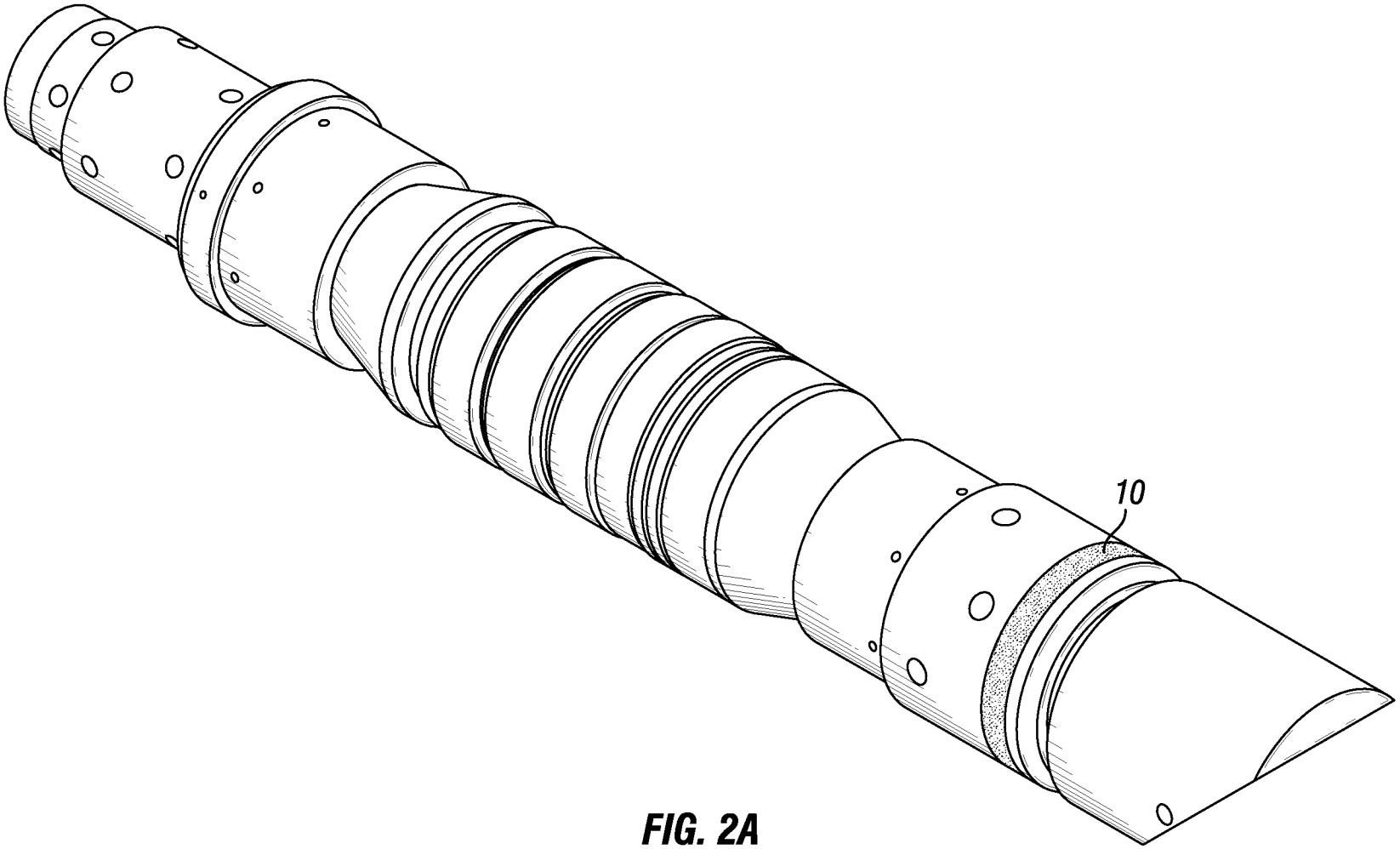
FIGS. 2A and 2B schematically illustrate a groove for a wear band to be placed circumferentially over the outer diameter of a tool, according to an embodiment of this disclosure.
Figure 2B:
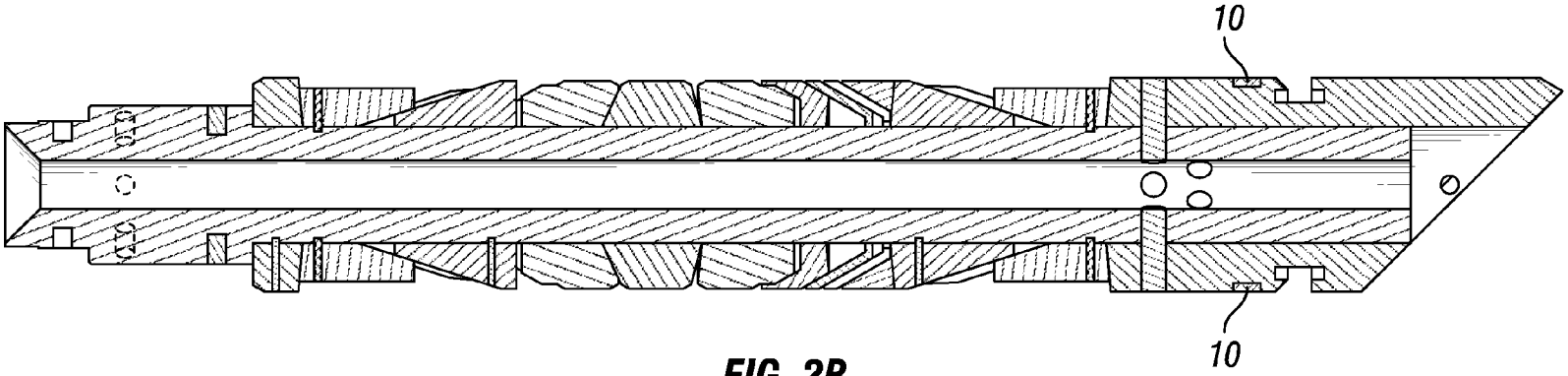

In an embodiment, referring to FIG. 2A, a groove 10 is shown to cover 360 degrees of a portion of the largest OD of the tool. A wear band will be made using groove 10. As shown in FIG. 2B, the wear band will be placed in the groove 10. In some cases, the groove is about 0.01-1.0 inch wide and 0.001-0.5 inch deep, running circumferentially for 360 degrees. The wear band is flush with the largest OD of the tool so that it protects the tool and do not hinder the use of the tool when it is run down hole.

In some embodiments, the groove (10 in FIGS. 2A and 2B) is filled with fiber reinforcement, resin, and a hard mineral. The hard mineral may be any suitable material as known to one skilled in the art, such as alumina oxide, carbide, poly crystalline diamond (PCD), or combinations thereof.

Figure 3:
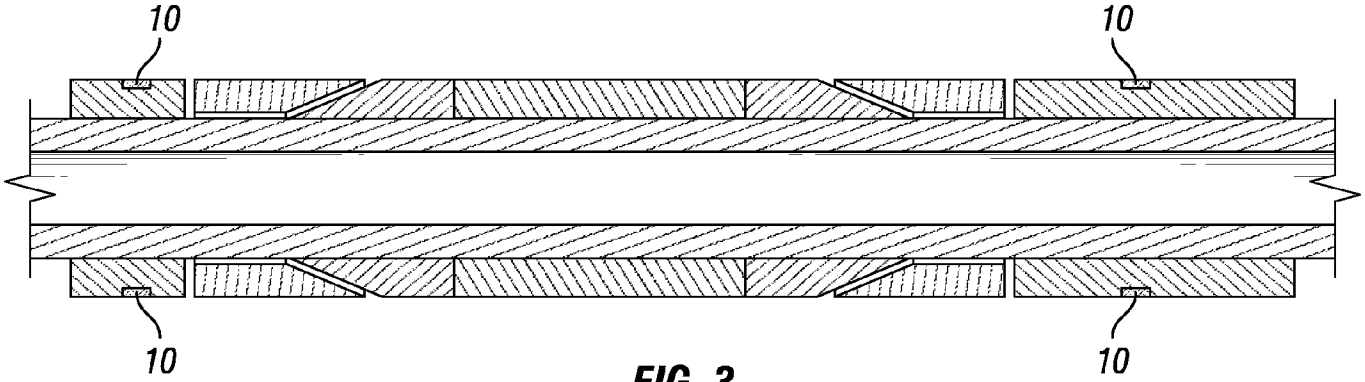
FIG. 3 is a cross section view, illustrating two wear bands placed circumferentially over the outer diameter of a tool, according to an embodiment of this disclosure.

In some embodiments, as shown in FIG. 3, more than one wear band (10) is placed over the tool. Any number of wear bands may be used at various locations as needed/desired.

Method of Making Wear Band.

In an embodiment, groove 10 as shown in FIGS. 2A and 2B is wrapped with fiber reinforcement. Resin and a hard mineral is added as the tool is rotated/turned around its longitudinal axis. This process builds up thickness while adding hardness. The tool/part is then cured according to best practices. For example, the part is cured at a temperature in the range of from 150° F. to 450° F. A stepped cure may also be specified depending on the combination of materials chosen or used. The amount of time varies depending on the materials chosen, for example, from 1 to 24 hours. When completed, the wear band is flush with the largest OD of the tool so that it protects the tool and does not hinder the use of the tool when it is run down hole.

In another embodiment, a pre-preg material is used to make the wear band. The pre-preg material is wrapped around the largest OD of the tool and a hard mineral is sprinkled on top. This process continues until a desired thickness is built up. The thickness can be anywhere from 0.001 inch to 0.5 inch. The tool/part is then cured according to best practices. When finished, the wear band is flush with the largest OD of the tool so that it protects the tool and do not hinder the use of the tool when it is run down hole.

It should be understood that mule shoe has other names as known to one skilled in the art and all such equivalents are considered to be within the scope of this disclosure. Furthermore, any kind of fiber, hard mineral, and resin may be used to make the wear band.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A downhole tool comprising:

a 360-degree wear band placed circumferentially around a portion of the largest outer diameter (OD) of said downhole tool, wherein said wear band is made by a process including:

rotating said downhole tool along a longitudinal axis of said downhole tool;

wrapping a groove created around said downhole tool with a pre-preg material;

sprinkling a hard mineral on top of the pre-preg material;

continuing rotating the downhole tool, wrapping the groove and sprinkling the hard mineral such that the pre-preg material and the hard mineral sprinkled between successive wraps of pre-preg material form a wear band and said wear band is formed flush with the largest OD of the downhole tool along an entire width of the wear band; and curing the wear band on the downhole tool.

2. The downhole tool of claim 1, wherein said hard mineral comprises alumina oxide, carbide, poly crystalline diamond, or combinations thereof.

3. The downhole tool of claim 1, wherein said wear band has a thickness of from about 0.001 inch to about 0.5 inch or wherein said wear band has a width of from about 0.01 inch to about 1.0 inch.

4. The downhole tool of claim 1 comprising more than one 360-degree wear band made by the process.

5. The downhole tool of claim 1, wherein the wear band protects the downhole tool from wear and damage.

6. A method of making a downhole tool comprising creating a 360-degree groove around a portion of the largest outer diameter (OD) of said downhole tool circumferentially, wherein said downhole tool comprises a longitudinal axis;

rotating the downhole tool along its longitudinal axis;

wrapping the groove with a pre-preg material;

sprinkling a hard mineral on top of the pre-preg material;

continuing rotating the downhole tool, wrapping the groove and sprinkling the hard mineral such that the pre-preg material and the hard mineral sprinkled between successive wraps of pre-preg material form a wear band and the wear band is formed flush with the largest OD of the downhole tool along an entire width of the wear band; and curing the wear band on the downhole tool.

7. The method of claim 6, wherein more than one wear band is formed on said downhole tool.

8. The method of claim 6, wherein the groove is about 0.01-1.0 inch wide or 0.001-0.5 inch deep or both.

9. The method of claim 6, wherein said hard mineral comprises alumina oxide, carbide, poly crystalline diamond, or combinations thereof.

10. The method of claim 9, wherein the wear band protects the downhole tool from wear and damage.

* * * * *